US008208827B2

(12) United States Patent
Sakata

(10) Patent No.: US 8,208,827 B2
(45) Date of Patent: Jun. 26, 2012

(54) IMAGE FORMING APPARATUS, CONTROL METHOD THEREFOR, PROGRAM, AND STORAGE MEDIUM

(75) Inventor: Katuaki Sakata, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 467 days.

(21) Appl. No.: 12/200,238

(22) Filed: Aug. 28, 2008

(65) Prior Publication Data

US 2009/0067863 A1 Mar. 12, 2009

(30) Foreign Application Priority Data

Sep. 11, 2007 (JP) ..... 2007-235946

(51) Int. Cl.

| | |
|---|---|
| ***G03G 15/00*** | (2006.01) |
| ***G03G 15/01*** | (2006.01) |
| ***G03G 15/16*** | (2006.01) |
| ***G03G 15/20*** | (2006.01) |

(52) U.S. Cl. ..... 399/82; 399/66; 399/67; 399/231; 399/341; 399/401

(58) Field of Classification Search ..... None
See application file for complete search history.

(56) References Cited

U.S. PATENT DOCUMENTS

| | | | | |
|---|---|---|---|---|
| 2003/0007814 | A1* | 1/2003 | Richards | 399/341 |
| 2004/0033085 | A1* | 2/2004 | Misaizu et al. | 399/130 |
| 2007/0115490 | A1* | 5/2007 | Yada | 358/1.13 |

FOREIGN PATENT DOCUMENTS

| | | | |
|---|---|---|---|
| JP | 2002-207334 | A | 7/2002 |
| JP | 2002-318482 | A | 10/2002 |
| JP | 2007-011028 | | 1/2007 |
| WO | WO 2007-004411 | A1 | 1/2007 |

OTHER PUBLICATIONS

The above references were cited in a Feb. 27, 2012 Japanese Office Action, which is enclosed without an English Translation, that issued in Japanese Patent Application No. 2007-235946.

* cited by examiner

*Primary Examiner* — David Gray
*Assistant Examiner* — David Bolduc
(74) *Attorney, Agent, or Firm* — Cowan, Liebowitz & Latman, P.C.

(57) ABSTRACT

An image forming apparatus equipped with an image forming unit capable of image formation using color toner and transparent toner includes, a determining unit to determine whether each pixel of image data belongs to an image region or a text region; a control unit to control the image forming unit by switching between transfer of a toner image to the image region and transfer of a toner image to the text region; a fixing unit to fix the toner image formed on recording material; and a transport unit to discharge the recording material on which the toner image is fixed or re-feed the recording material to the image forming unit.

7 Claims, 9 Drawing Sheets

IMAGE FORMING APPARATUS, CONTROL METHOD THEREFOR, PROGRAM, AND STORAGE MEDIUM

BACKGROUND OF THE INVENTION

1. Field of the Invention

The present invention relates to an image forming technique which uses color toner and transparent toner.

2. Description of the Related Art

In electrophotographic color image formation, it has recently been a known practice to increase glossiness of a formed image using a transparent toner in addition to conventional color toners such as yellow, magenta, cyan, and black toners. Conventionally, glossy prints are produced by fixing transparent and color toners simultaneously or by fixing a transparent toner after fixing color toners.

Examples of conventional techniques such as described above include a technique disclosed in Japanese Patent Laid-Open No. 2007-011028 described below.

However, there are limits to amounts of toner that can be applied to a recording material. In image forming regions, depending on the amounts of applied color toner, the amount of transparent toner will become nonuniform, causing the problem of gloss irregularities. FIGS. 10A to 10C are diagrams schematically showing amount-of-applied-toner control for cyan (C), magenta (M), yellow (Y), black (K), and transparent toners in image formation according to the conventional technique. Reference numeral 10002 denotes an amount-of-applied-toner limit which represents a limit to the amounts of toner which can be applied to a recording material 10001 by one fixing operation. In amount-of-applied-toner control 10003, the amount-of-applied-toner limit 10002 is reached by Y, M, C, and K, making it impossible to further apply a transparent toner. In amount-of-applied-toner control 10004 to 10007, the proportions of color toners (cyan (C), magenta (M), yellow (Y), and black (K)) are lower than in the amount-of-applied-toner control 10003. This makes it possible to apply the transparent toner within the amount-of-applied-toner limit 10002. In amount-of-applied-toner controls 10005, 10006, and 10007, the transparent toner can be applied uniformly (in FIG. 10A, the amount of applied transparent toner is taken as 1).

Gradation images in FIG. 10B schematically show results of image formation based on the amount-of-applied-toner control in FIG. 10A. A nonuniform glossy effect is observed in the gradation image 10011 in FIG. 10B because the transparent toner has been applied nonuniformly as in the case of the amount-of-applied-toner controls 10004 and 10005 (FIG. 10A), for example. The gradation image 10010 shows no glossy effect because the transparent toner has not been applied as in the case of the amount-of-applied-toner control (FIG. 10A).

On the other hand, when color toner and transparent toner are fixed separately, a uniform glossy effect is obtained because the transparent toner can be applied uniformly, but two fixing operations are required, causing the problem of misregistration between the color toner and transparent toner. This problem comes to the fore in image formation for text images.

SUMMARY OF THE INVENTION

The present invention has been made in view of the above problems and has an object to fix transparent toner appropriately and achieve gloss using the transparent toner in any of regions with different properties, such as image regions and text regions.

An image forming apparatus according to the present invention which achieves the above object mainly includes the following configurations.

According to one aspect of the present invention, there is provided an image forming apparatus which includes an image forming unit capable of image formation using color toner and transparent toner, comprising: a determining unit adapted to determine whether each pixel of image data belongs to an image region or a text region; a control unit adapted to control the image forming unit by switching between transfer of a toner image to the image region and transfer of a toner image to the text region based on a result of determination produced by the determining unit; a fixing unit adapted to fix the toner image formed on recording material under the control of the control unit; and a transport unit adapted to discharge the recording material on which the toner image is fixed or re-feed the recording material to the image forming unit under the control of the control unit.

Alternatively, a control method for an image forming apparatus according to the present invention which achieves the above object includes the following steps.

According to another aspect of the present invention, there is provided a control method for an image forming apparatus which includes an image forming unit capable of image formation using color toner and transparent toner, the control method comprising: a determining step of determining whether each pixel of image data belongs to an image region or a text region; a control step of controlling the image forming unit by switching between transfer of a toner image to the image region and transfer of a toner image to the text region based on a result of determination produced by the determining step; a fixing step of fixing the toner image formed on recording material under the control of the control step; and a transport step of discharging the recording material on which the toner image is fixed or re-feeding the recording material to the image forming unit under the control of the control step.

By determining properties of regions in image data and fixing color toner and transparent toner simultaneously in regions determined to be text regions, the present invention makes it possible to prevent misregistration between the color toner and transparent toner.

Also, by fixing color toner and transparent toner separately in regions determined to be image regions and thereby applying a uniform amount of transparent toner, it is possible to eliminate gloss irregularities and thereby achieve a uniform glossy effect.

Further features of the present invention will become apparent from the following description of exemplary embodiments with reference to the attached drawings.

DESCRIPTION OF THE EMBODIMENTS

Preferred embodiments of the present invention will be described in detail below by way of example with reference to the drawings. It should be noted, however, that the components described in the embodiments are provided only as an example and that the technical scope of the present invention is defined only by the appended claims, and is not limited to any particular embodiment described below.

(First Embodiment)

(Configuration of Image Forming System)

Figure 1:
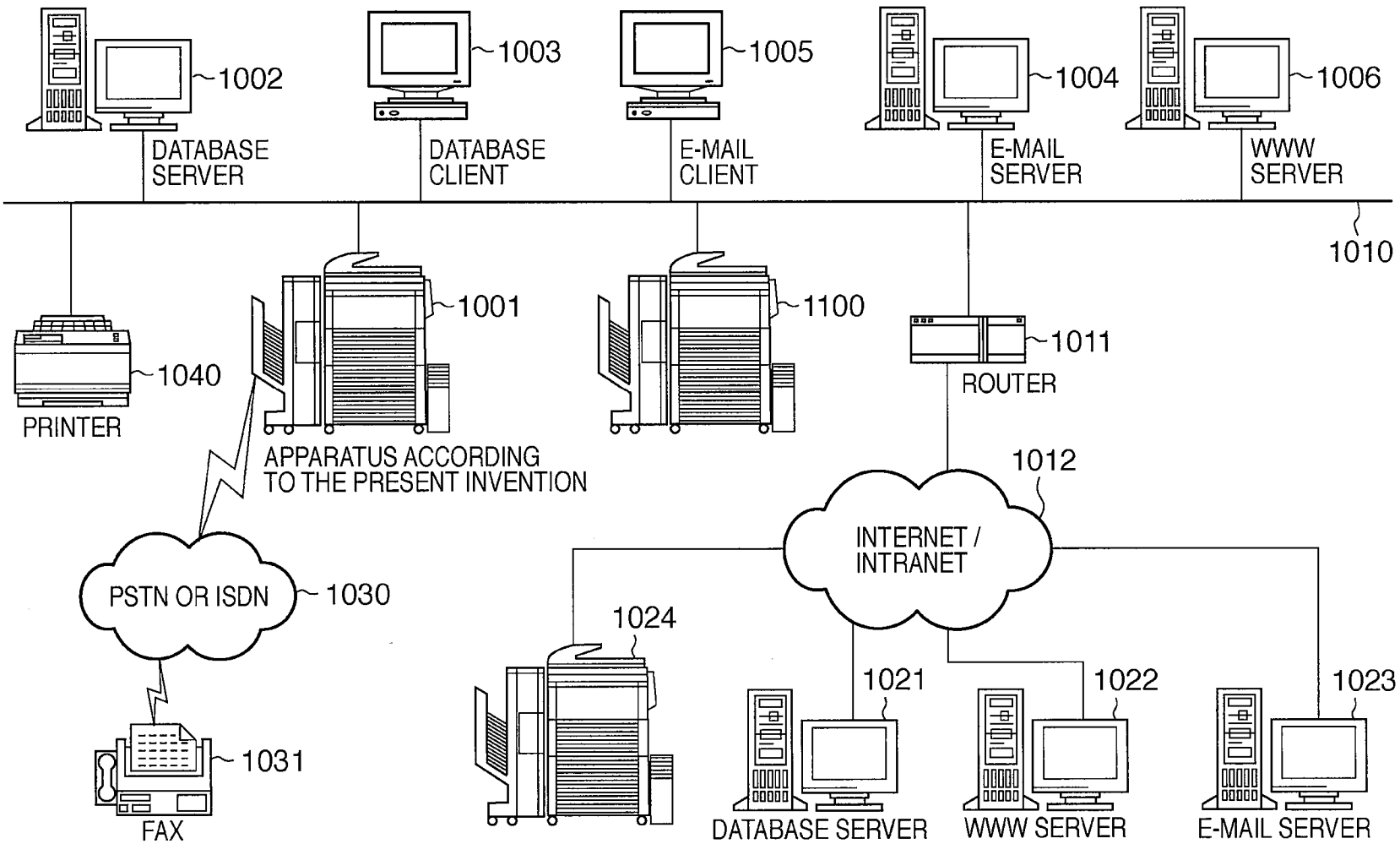
FIG. 1 is a diagram showing an overall configuration of an image forming system according to an embodiment of the present invention.

FIG. 1 is a diagram showing an overall configuration of an image forming system according to an embodiment of the present invention. An image forming apparatus 1001 includes a scanner which reads images and printer which prints out images, as components. The image forming apparatus 1001 can deliver images read by the scanner to equipment connected to a local area network 1010 (hereinafter referred to as the LAN). Also, the image forming apparatus 1001 can print out images received via the LAN 1010 on the printer. The image forming apparatus 1001 can also transmit images read by the scanner, via PSTN or ISDN 1030 using a FAX unit (not shown). Also, the image forming apparatus 1001 can print out images received via PSTN or ISDN 1030 on the printer.

A database server 1002 can function as a database which manages binary images or multi-valued images of images read by the image forming apparatus 1001.

A database client 1003, which is a client of the database server 1002, can store data, do database maintenance, and refer to data by accessing the database server 1002.

An e-mail server 1004 can receive images read by the image forming apparatus 1001, as e-mail attachments. An e-mail client 1005, which is a client of the e-mail server 1004, can view e-mail received by the e-mail server 1004 and transmit e-mail.

A WWW server 1006 can provide HTML documents to equipment on the LAN 1010. The image forming apparatus 1001 can print out the HTML documents provided by the WWW server.

A router 1011 can connect the LAN 1010 to the Internet/intranet 1012. The Internet/intranet 1012 is connected with the database server 1002, WWW server 1006, and e-mail server 1004 as well as with a database server 1021, WWW server 1022, e-mail server 1023, and image forming apparatus 1024.

Furthermore, the image forming apparatus 1001 can exchange image data with a fax machine 1031 via the PSTN or ISDN 1030. The LAN 1010 is connected with a printer 1040 and can print out images read by the image forming apparatus 1001, using the printer 1040. The LAN 1010 is also connected with another image forming apparatus 1100 which can implement functions similar to those of the image forming apparatus 1001. The plurality of image forming apparatus 1001 and 1100 can exchange image data with each other. Thus, images read by the image forming apparatus 1001 can be printed out using printer functions of the image forming apparatus 1100. Conversely, images read by the image forming apparatus 1100 can be printed out using printer functions of the image forming apparatus 1001.

(Configuration of Image Forming Apparatus)

Figure 2:
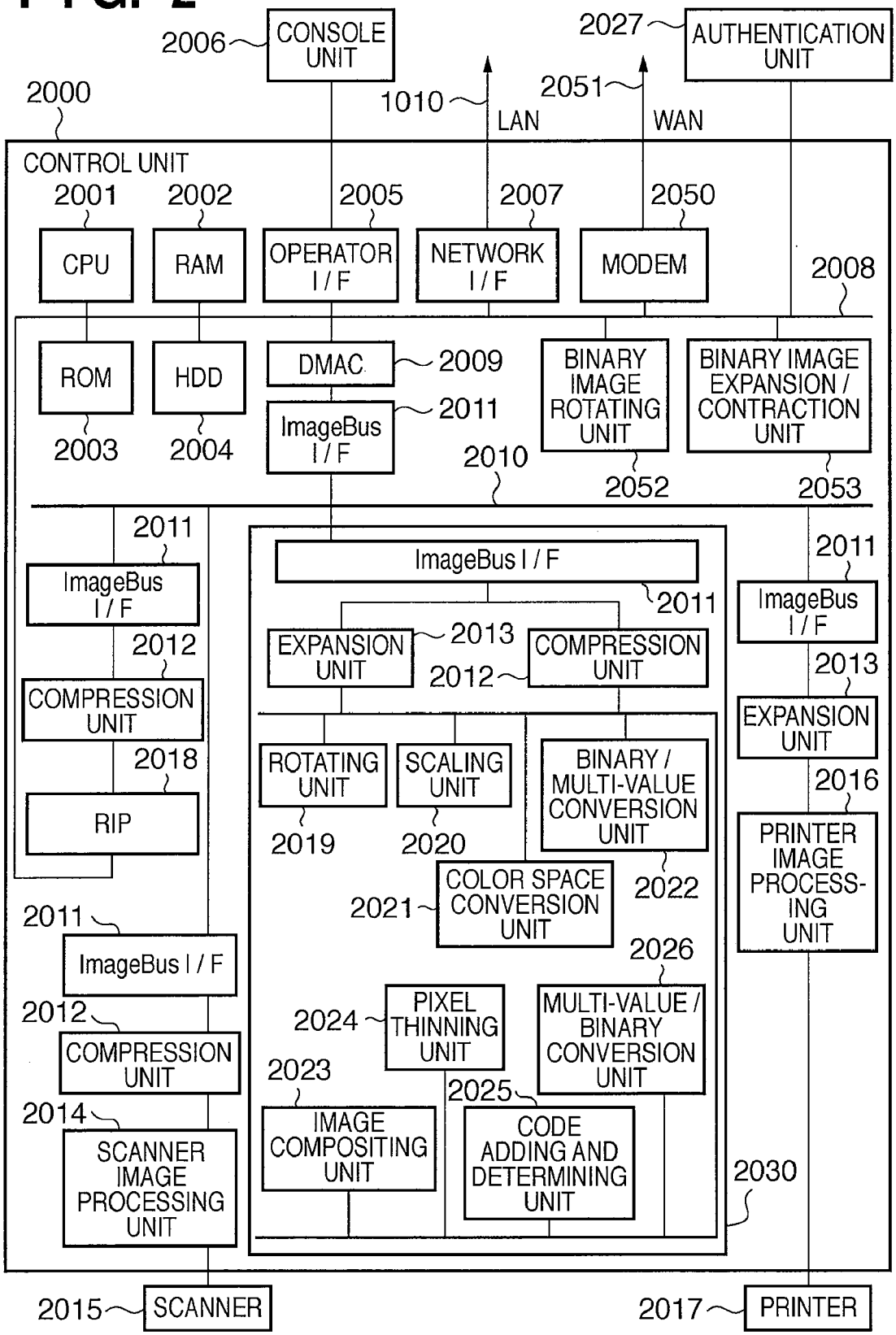
FIG. 2 is a block diagram illustrating a schematic functional configuration of an image forming apparatus according to the embodiment of the present invention.

FIG. 2 is a block diagram illustrating a schematic functional configuration of the image forming apparatus 1001 according to the embodiment of the present invention.

A CPU 2001 can undertake overall control in a control unit 2000. The control unit 2000 is connected with a scanner 2015 which is an image input device and a printer 2017 which is an image output device.

The scanner 2015 can convert images it reads (i.e., scanned documents) into electronic form. The control unit 2000 can store the images in electronic form on an HDD 2004, perform various types of image processing (e.g., correction, manipulation, and editing) on the images, and output the image data subjected to the various types of image processing to the printer 2017. Also, being connected to the LAN 1010 and a public network (WAN) 2051, the control unit 2000 can exchange image information and device information with equipment ready to communicate via the LAN 1010 or public network (WAN) 2051. The image information includes, for example, the image data subjected to the various types of image processing as well as the images in electronic form.

A RAM 2002, which provides working memory for operation of the CPU 2001, functions as image memory to temporarily store image data. A ROM 2003 is a boot ROM which stores a boot program of the image forming apparatus 1001. The HDD 2004, that is, a hard disk drive, stores software used to control the image forming apparatus 1001, as well as images in electronic form and image data subjected to various types of image processing. The HDD 2004 also stores authentication data transmitted from the database server 1002 via the LAN 1010 or WAN 2051.

An operator I/F 2005, which provides an interface between a console unit (UI) 2006 and the control unit 2000, outputs image data for display on the console unit 2006 to the console unit 2006. Also, the operator I/F 2005 can transmit information about commands entered by a user via the console unit 2006 to the CPU 2001. A network I/F 2007 can connect to the LAN 1010 and input and output image information via the LAN 1010. A modem 2050 can connect to the public network 2051 and input and output image information via the public network 2051.

A binary image rotating unit 2052 and binary image expansion/contraction unit 2053 can transform a direction of a binary image and adjust resolution of the image to predetermined resolution or to capacity of a destination apparatus before transmitting the image from the modem 2050. The binary image expansion/contraction unit 2053 supports, for example, JBIG, MMR, MR, and MH as image expansion/contraction formats.

An authentication unit 2027 is an interface which detects an IC card or biometric feature for use in user authentication. Results of the authentication is inputted in the binary image expansion/contraction unit 2053. When user authentication succeeds based on results of the authentication by the authentication unit 2027, the binary image expansion/contraction unit 2053 can carry out expansion/contraction.

A DMAC 2009 is a DMA controller which can read images stored in the RAM 2002 by bypassing the CPU 2001 and transfer the images to an image bus 2010. Also, the DMAC 2009 can write images transferred via the image bus 2010 into the RAM 2002 by bypassing the CPU 2001.

A raster image processor (RIP) 2018 receives PDL code from a host computer via the network I/F 2007 and stores the PDL code in the RAM 2002 via a system bus 2008. The CPU 2001 can convert the PDL code into intermediate code, input the intermediate code in the RIP 2018 via the system bus 2008 again, and convert the intermediate code into a bitmap image (multi-valued image).

The devices described above are connected to the system bus 2008.

An image conversion unit 2030 has functions for performing various conversion processes on images in the RAM 2002. An image bus I/F (ImageBus I/F) 2011 can control high-speed input and output of images via the image bus 2010. A compression unit 2012 JPEG-compresses an image, for example, in 32-by-32 pixel blocks before sending out the image to the image bus 2010. Incidentally, the compression method is not limited to this example, and may compress part of the image in n-by-n pixel blocks (where n is a natural number). An expansion unit 2013 can expand an image transmitted via the image bus 2010 using an appropriate expansion method.

A rotating unit 2019 can rotate a 32-by-32 pixel image at a specified angle. The rotating unit 2019 supports input and output of both binary and multi-valued images.

A scaling unit 2020 has functions for changing the resolution of an image (e.g., from 600 dpi to 200 dpi) and scaling up/down the image (e.g., from 25% to 400%). The scaling unit 2020 performs scaling processing by rearranging a 32-by-32 pixel image into a 32-line image.

A color space conversion unit 2021 can perform matrix calculations on an image received as multi-valued data, convert, for example, a YUV image in memory into a Lab image with reference to an LUT, and store the Lab image in memory. The color space conversion involves 3-by-8 matrix calculations and a one-dimensional LUT and can be used for background removal and show-through prevention.

A binary/multi-value conversion unit 2022 can convert a 1-bit binary image into an 8-bit, 256-gradation image. Conversely, a multi-value/binary conversion unit 2026 can convert, for example, an 8-bit, 256-gradation image in memory into a 1-bit binary image using a technique such as error-diffusion processing and store the resulting image in memory.

An image compositing unit 2023 has functions for compositing two multi-valued images (or binary images) in memory and thereby producing one multi-valued image (or a binary image). For example, by compositing an original image with an image of a company logo, it is possible to generate a composite image in which the company logo is superimposed on the original image. Regarding a composition technique, the image compositing unit 2023 can take an average on a pixel by pixel basis. Alternatively, based on a luminance level, the image compositing unit 2023 can use the value of the brighter pixel or the value of the darker pixel as the value of the pixel after the composition. Also, the image compositing unit 2023 can use an OR operation, AND operation, or exclusive OR operation on a pixel by pixel basis.

A pixel thinning unit 2024 can convert resolution by thinning pixels of a multi-valued image, and thereby generate and output a ½, ¼, or ⅛ multi-valued image. When used in conjunction with the pixel thinning unit 2024, the scaling unit 2020 can scale up and down a wider range of images.

A code adding and determining unit 2025 can add various information such as a desired symbol (two-dimensional bar code), watermark, or copy-forgery-inhibited pattern to an input image.

A scanner image processing unit 2014 performs various types of appropriate image processing (e.g., correction, manipulation, and editing) on color images or black and white images from the scanner 2015. The image data subjected to the various types of image processing is inputted in the compression unit 2012. As described above, the compression unit 2012 JPEG-compresses the image data, for example, in 32-by-32 pixel blocks and sends out the image data to the image bus 2010 via the image bus I/F 2011.

A printer image processing unit 2016 can perform various types of appropriate image processing (e.g., correction, manipulation, and editing) for the printer 2017. As described above, the expansion unit 2013 expands the image transmitted via the image bus 2010 using an appropriate expansion method. After the expansion, the printer image processing unit 2016 can send out the image data subjected to the various types of image processing to the printer 2017.

Figure 3:
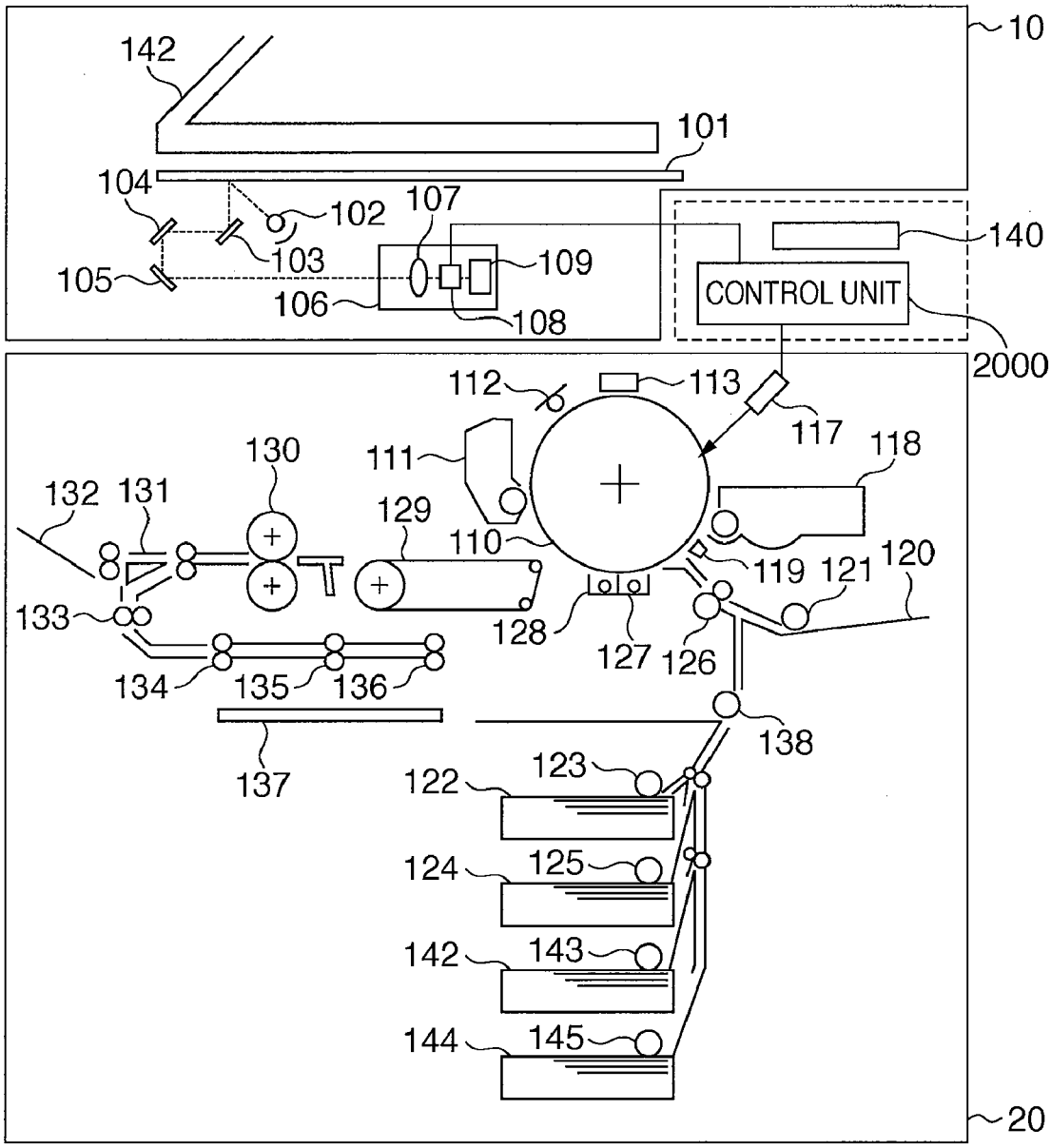
FIG. 3 is a block diagram illustrating a configuration of the image forming apparatus according to the embodiment of the present invention.

FIG. 3 is a block diagram illustrating a configuration of the image forming apparatus. Documents supplied from an automatic document feeder 142 are put in place on a platen 101 one after another. A document-illuminating lamp 102, which is, for example, a halogen lamp, exposes the document placed on the platen 101. Scanning mirrors 103, 104, and 105, which are housed in an optical scanning unit (not shown) can lead reflected light from the document to a CCD unit 106 by performing a reciprocating motion.

The CCD unit 106 includes a focusing lens 107 which focuses the reflected light from the document on a CCD, an image pickup device 108 which is, for example, a CCD, and CCD driver 109 which drives the image pickup device 108. An image signal output from the image pickup device 108 is input in the control unit 2000 described with reference to FIG. 2 after being converted into, for example, a 8-bit digital data.

A photosensitive drum 110 is de-staticized by a pre-exposure lamp in preparation for image formation. A primary charger 113 charges the photosensitive drum 110 uniformly. An exposure unit 117, which is, for example, a semiconductor laser or the like, exposes the photosensitive drum 110 based on image data processed by the control unit 2000 and thereby forms an electrostatic latent image, where the control unit 2000 controls image formation and the entire apparatus.

A developing unit 118 contains a developer (toner). FIG. 3 shows, by way of example, a configuration which uses a developer (toner) of one color (black). However, to form a color image, similar developing units and photosensitive drums are provided for yellow, magenta, and cyan as well. Furthermore, when a transparent toner is used, a similar developing unit and photosensitive drum are provided for the transparent toner as well.

A pre-transfer charger 119 applies high pressure before a developed toner image is transferred from the photosensitive drum 110 to recording material. Paper feed units 120, 122, 124, 142, 144 (where the paper feed unit 120 is a manual feed unit) house various recording materials for image formation. When a recording material is selected under the control of the control unit 2000, the recording material is fed from an appropriate paper feed unit into the image forming apparatus by a paper feed roller 121, 123, 125, 143, or 145. By controlling a transport mechanism (not shown), the control unit 2000 stops the recording material once at a location of a resist roller 126 and controls the feeding of the recording material by synchronizing it with write timing of the image formed on the photosensitive drum 110.

A transfer charger 127 transfers the developed toner image from the photosensitive drum 110 to the fed recording material. A separation charger 128 separates the recording material which has gone through a transfer operation from the photosensitive drum 110. Any toner remaining on the photosensitive drum 110 without being transferred to the recording material is recovered by a cleaner 111. A transport belt 129 transports the recording material which has gone through a transfer process to a fixing unit 130. The fixing unit 130 fixes the toner image on the recording material by heating the recording material after the transfer process. Under the control of the control unit 2000, a flapper 131 switches a transport path of the recording material which has gone through the transfer process. As the flapper 131 switches the transport path, the recording material is transported to a location of a sorter 132 or intermediate tray 137. The CPU 2001 controls discharging of the recording material on which the toner image is fixed to the sorter 132 or re-feeding of paper to an image forming unit capable of forming an image using color toner and transparent toner.

Paper feed rollers 133 to 136 provide a transport mechanism (transport unit) for feeding recording material which has gone through a fixing process once to the intermediate tray 137 by reversing (multiple), or without reversing (duplex), the recording material.

According to the present embodiment, the use of the transport mechanism for reversal (multiple) makes it possible to transfer and fix transparent toner onto a specific region of the recording material by feeding the recording material again (re-feeding the paper) after transferring and fixing color toner onto the same recording material. Also, the color toner and transparent toner can be transferred and fixed at once. Detailed description thereof will be provided with reference to a flowchart in FIG. 4. A paper re-feed roller 138 transports the recording material placed on the intermediate tray 137 to a location of the resist roller 126 again. After the recording material is transported to the location of the resist roller 126, the transport of the recording material is controlled by the control unit 2000 in order for the transparent toner to be transferred.

(Image Formation Using Color Toner and Transparent Toner)

Figure 4:
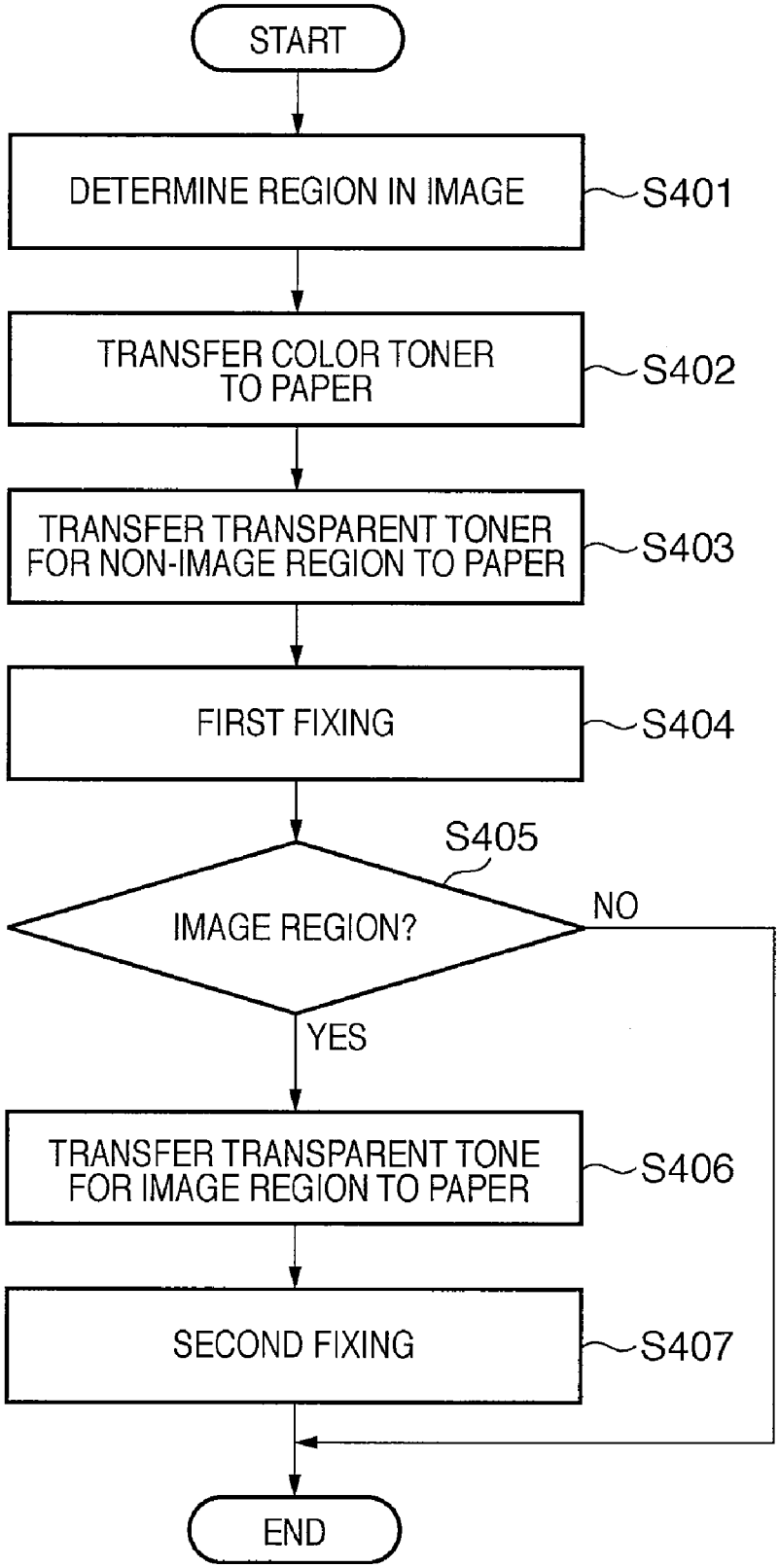
FIG. 4 is a diagram illustrating a control flow of the image forming apparatus in a first embodiment, where the image forming apparatus uses color toner and transparent toner.

A flow of an image forming process using color toners (cyan (C), magenta (M), yellow (Y), and black (K)) and a transparent toner will be described with reference to the flowchart in FIG. 4. The image forming process is performed under the overall control of the CPU 2001. The image formation using color toners described below can use a combination of cyan (C), magenta (M), yellow (Y), and black (K) or at least one of C, M, Y, and K.

First, in S401, the CPU 2001 determines a region in image data to be printed out. With reference to identification information attached to the image data and used to identify types of region (image region and text region), the CPU 2001 determines whether each pixel of the image data belongs to an image region or text region. Based on results of the identification, the CPU 2001 can identify regions (image region or text region) to be formed on the recording material. Based on the results of the identification, the CPU 2001 can switch between transfer of a toner image to an image region and transfer of a toner image to a text region.

In S402, the CPU 2001 makes an image forming unit transfer a toner image of color toners (C, M, Y, and K) to the recording material (first transfer) if it is determined in S401 that the region to be formed is an image region.

If the region to be formed is a text region, the CPU 2001 switches toner image transfer control and controls image formation so as to transfer, for example, a toner image of black (K) out of the color toners to the recording material.

Figure 7A:
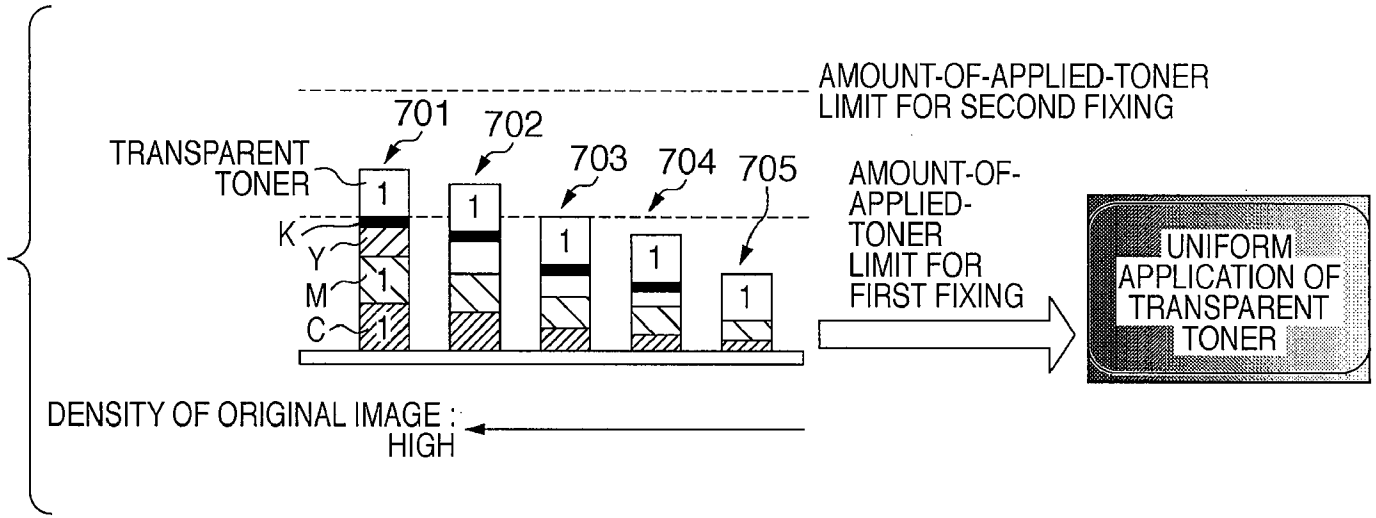
FIGS. 7A and 7B are diagrams schematically showing amount-of-applied-toner control in color image formation and monochrome image formation, respectively.
Figure 7B:
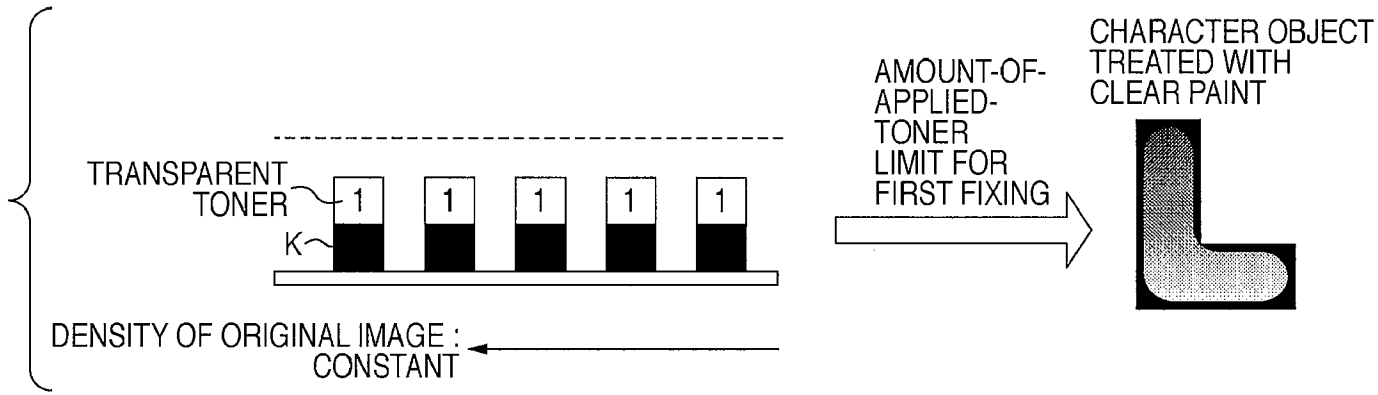

FIG. 7A is a diagram schematically showing amount-of-applied-toner control in color image formation and FIG. 7B is a diagram schematically showing amount-of-applied-toner control in monochrome image formation.

In S402, to form a color image in an image region, the CPU 2001 performs transfer control to transfer cyan (C), magenta (M), yellow (Y), and black (K) toners to the recording material (first transfer) as shown in FIG. 7A. On the other hand, to form a monochrome image in a text region, the CPU 2001 performs transfer control to transfer black (K) toner as shown in FIG. 7B.

In S403, the CPU 2001 performs transfer control to transfer transparent toner onto the text region other than the image region to the recording material. Consequently, the transparent toner is transferred uniformly over the black (K) toner as shown in FIG. 7B. In S402 and S403, the CPU 2001 makes the image forming unit transfer toner images of a color toner (e.g., black (K)) and transparent toner onto the text region to the recording material.

In S404, the CPU 2001 makes the fixing unit 130 fix the toners transferred in S402 and S403, to the recording material (first fixing process).

In the image region, the toner image transferred in the first transfer is fixed to the recording material by the fixing unit 130 (first fixing). Consequently, the color toner transferred to the image region is fixed by heating.

In the text region, the toner images of the color toner (e.g., black (K)) and transparent toner transferred to recording material are fixed to the recording material by the fixing unit 130. Also, in the text region, the color toner (e.g., black (K)) and the transparent toner transferred onto the color toner (e.g., black (K)) are fixed to the recording material by heating.

If no image region is found in S405 (S405: No), the process is finished. For example, if there is only a text region to be formed as shown in FIG. 7B, the process is finished.

On the other hand, if it is determined in S405 that there is an image region to be formed (S405: Yes), the CPU 2001 makes the transport mechanism transport the recording material to the intermediate tray 137.

Next, the CPU 2001 causes the transport mechanism which transports the recording material to re-feed the recording material which has undergone the first fixing, to the image forming unit. Next, the CPU 2001 makes the image forming unit transfer a toner image of transparent toner onto the toner image which has undergone the first fixing (second transfer).

That is, in S406, the CPU 2001 makes the transport mechanism resume transporting the recording material from the intermediate tray 137 in synchronization with the transfer of the transparent toner. Then, the CPU 2001 performs transfer control to transfer transparent toner to the image region of the re-fed recording material. Consequently, the transparent toner is transferred uniformly over the black (K) toner as shown in FIG. 7A. By transferring the transparent toner separately from the color toners, it is possible to transfer uniform amount of transparent toner onto the transferred and fixed color toners of cyan, magenta, yellow, and black without being limited by the amounts of toner applied in the first fixing. The amount of transparent toner can be changed within the amount-of-applied-toner limit for the second fixing as shown in FIG. 7A. The CPU 2001 performs transfer control to apply transparent toner in uniform amounts to the image regions within the amount-of-applied-toner limit for the second fixing.

In S407, the CPU 2001 makes the fixing unit 130 perform a second fixing process. That is, the fixing unit 130 fixes the toner image of transparent toner to the recording material, where the toner image have gone through the second transfer. Consequently, the transparent toner transferred onto the color toners is fixed by heating. This ends the entire process.

According to the present embodiment, by fixing color toner and transparent toner simultaneously to regions determined to be text regions, it is possible to prevent misregistration between the color toner and transparent toner. Also, by fixing color toner and transparent toner separately in regions determined to be image regions and thereby applying a uniform amount of transparent toner, it is possible to eliminate gloss irregularities and thereby achieve a uniform glossy effect.

(Second Embodiment)

Figure 5:
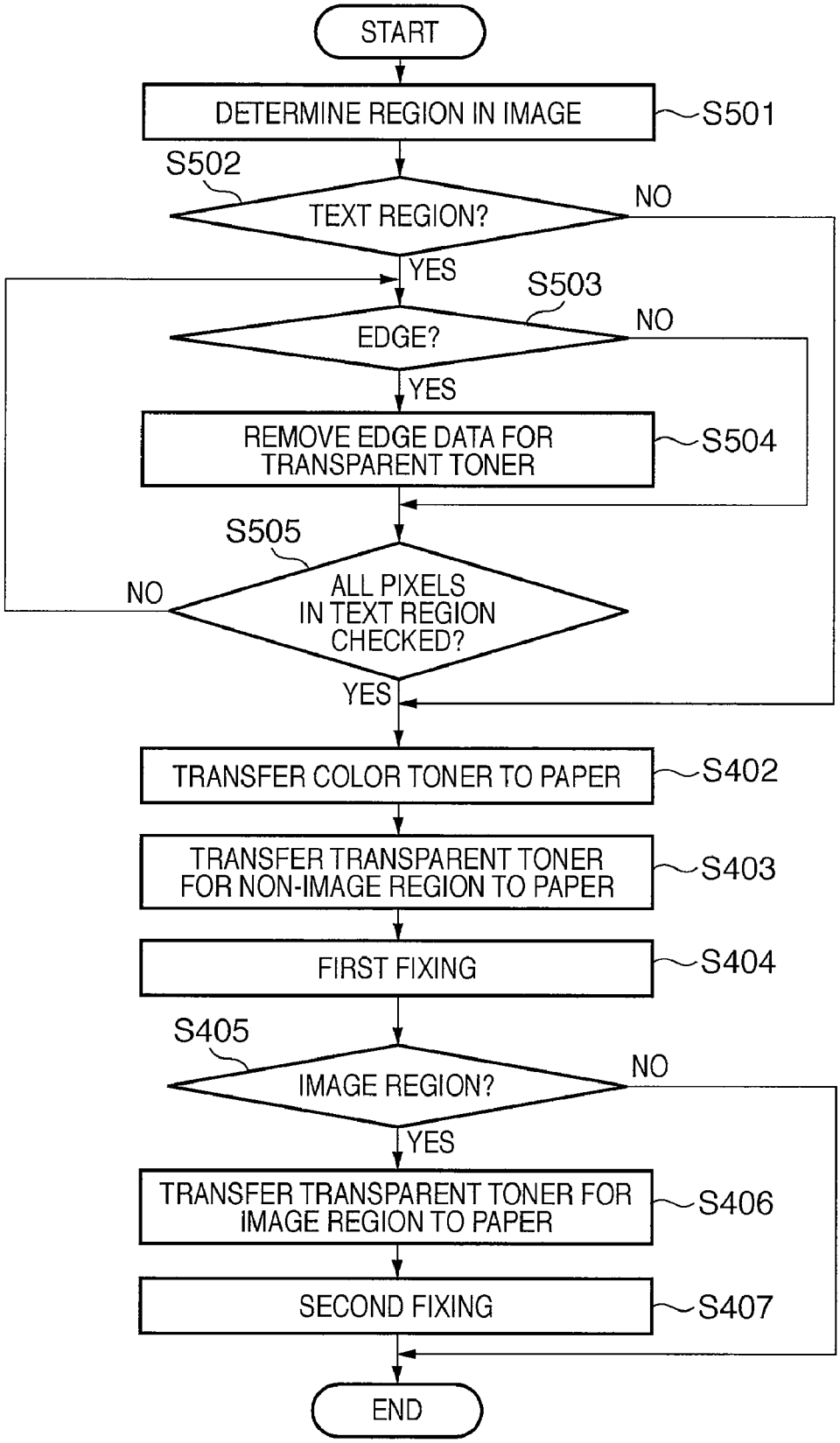
FIG. 5 is a diagram illustrating a control flow of the image forming apparatus in a second embodiment, where the image forming apparatus uses color toner and transparent toner.
Figure 8:
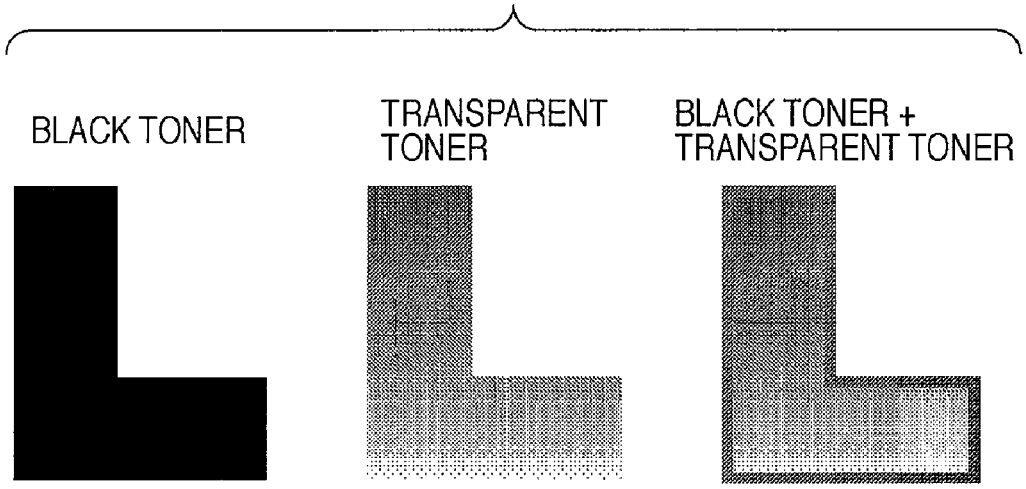
FIG. 8 is a diagram illustrating image formation according to the second embodiment.

Next, a second embodiment of the present invention will be described with reference to FIGS. 5 and 8. FIG. 5 is a flowchart illustrating a flow of an image forming process according to the second embodiment. The image forming process is performed under the overall control of the CPU 2001. The same processes as those in the first embodiment (FIG. 4) will be denoted by the same step numbers as the corresponding processes in the first embodiment, and a redundant description thereof will be omitted.

Figure 10A:
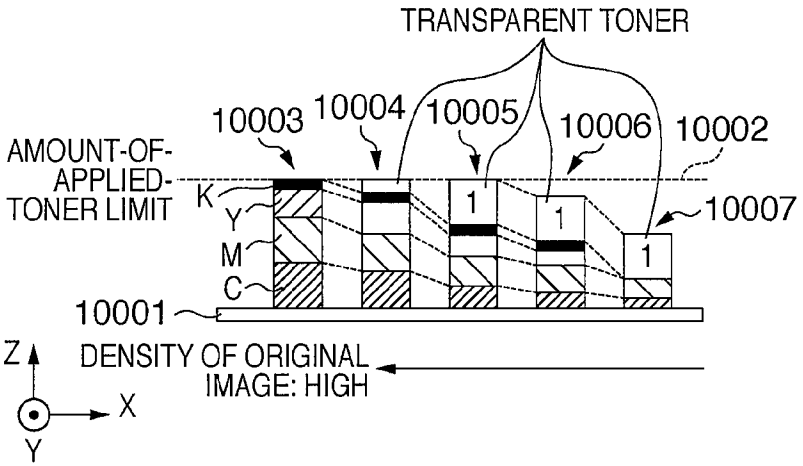
FIGS. 10A to 10C are diagrams schematically showing amount-of-applied-toner control for cyan (C), magenta (M), yellow (Y), black (K), and transparent toners in image formation according to a conventional technique.
Figure 10B:
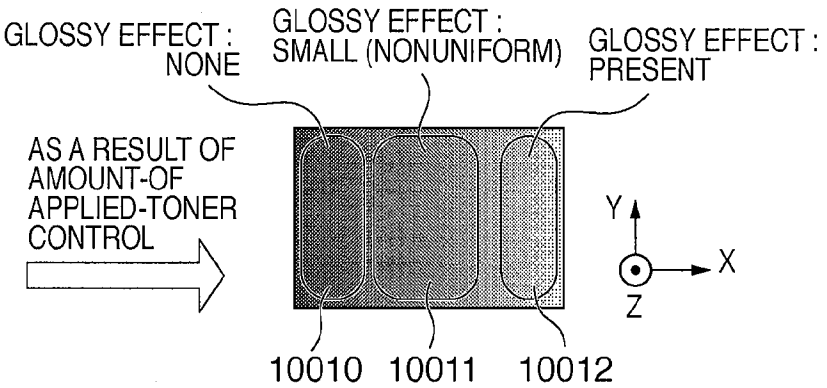
Figure 10C:
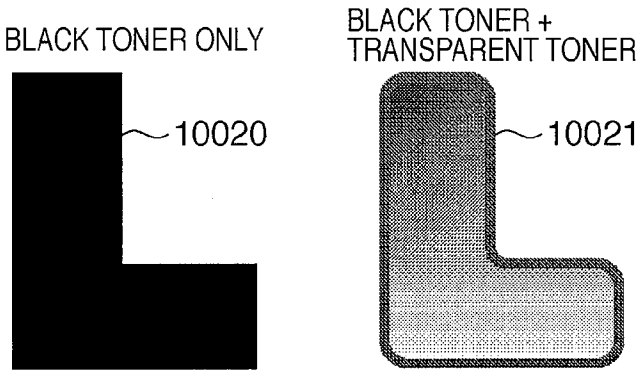

In text image formation, color toner and transparent toner will get mixed when the toners are fixed to the recording material. Consequently, the color toner appears to be splashed, particularly on the edges. FIG. 10C is a diagram showing, by way of example, a case in which the letter "L" is formed using black toner alone and a case in which the letter "L" is formed using a combination of black toner and transparent toner. Whereas the letter "L" 10020 formed by black toner alone has clear outlines, the letter "L" 10021 formed by a combination of black toner and transparent toner has the problem of reduced sharpness in character outlines.

According to the second embodiment, to prevent loss of sharpness in character (text) outlines, edge data for transparent toner in text regions is removed.

Next, the flow of the image forming process according to the second embodiment will be described with reference to FIG. 5. First, in S501, the CPU 2001 determines a region in an image to be printed out. By referring to region information which, being attached to the image data, indicates the type of region regarding each pixel of the image data, the CPU 2001 can determine whether the region is an image region which forms graphics or a text region (inner part of the text region or an edge of the text region) which forms characters. Based on the information (region information) which identifies the type of region, the CPU 2001 can determine an edge of the text region.

In S502, the CPU 2001 determines whether the region checked in S501 is a text region. If the region is not a text region (S502: No), the CPU 2001 goes to S402. On the other hand, if the region is determined to be a text region in S502 (S562: Yes), the CPU 2001 goes to S503 to determine whether a given pixel belongs to an edge of the text region.

If it is determined in S503 that the pixel does not belong to an edge (S503: No), the CPU 2001 goes to S505. On the other hand, if it is determined in S503 that the pixel belongs to an edge of the text region (S503: Yes), the CPU 2001 goes to S504.

In S504, the CPU 2001 makes the image forming unit remove that part which corresponds to the edge of the text region from original image data, and then transfer a toner image of transparent toner (first transfer) based on resulting image data.

In S505, the CPU 2001 determines whether all pixels in the text region have been checked in S503.

If not all the pixels in the text region have been checked (S505: No), the CPU 2001 returns to S503 and repeats S503 to S505. On the other hand, if it is determined in S505 that all the pixels in the text region have been checked in S503, the CPU 2001 goes to S402.

In S402 to S407, the CPU 2001 performs the same processes as in the first embodiment described with reference to FIG. 4.

According to the present embodiment, edge data for transparent toner in text regions is removed, reducing the data for transparent toner regions by the amount equal to the removed data compared to the data for black toner regions. This makes it possible to prevent color toner from being splashed and thereby prevent loss of sharpness in character outlines when transparent toner is applied over the color toner (e.g., black toner) in the text regions.

(Third Embodiment)

Figure 6:
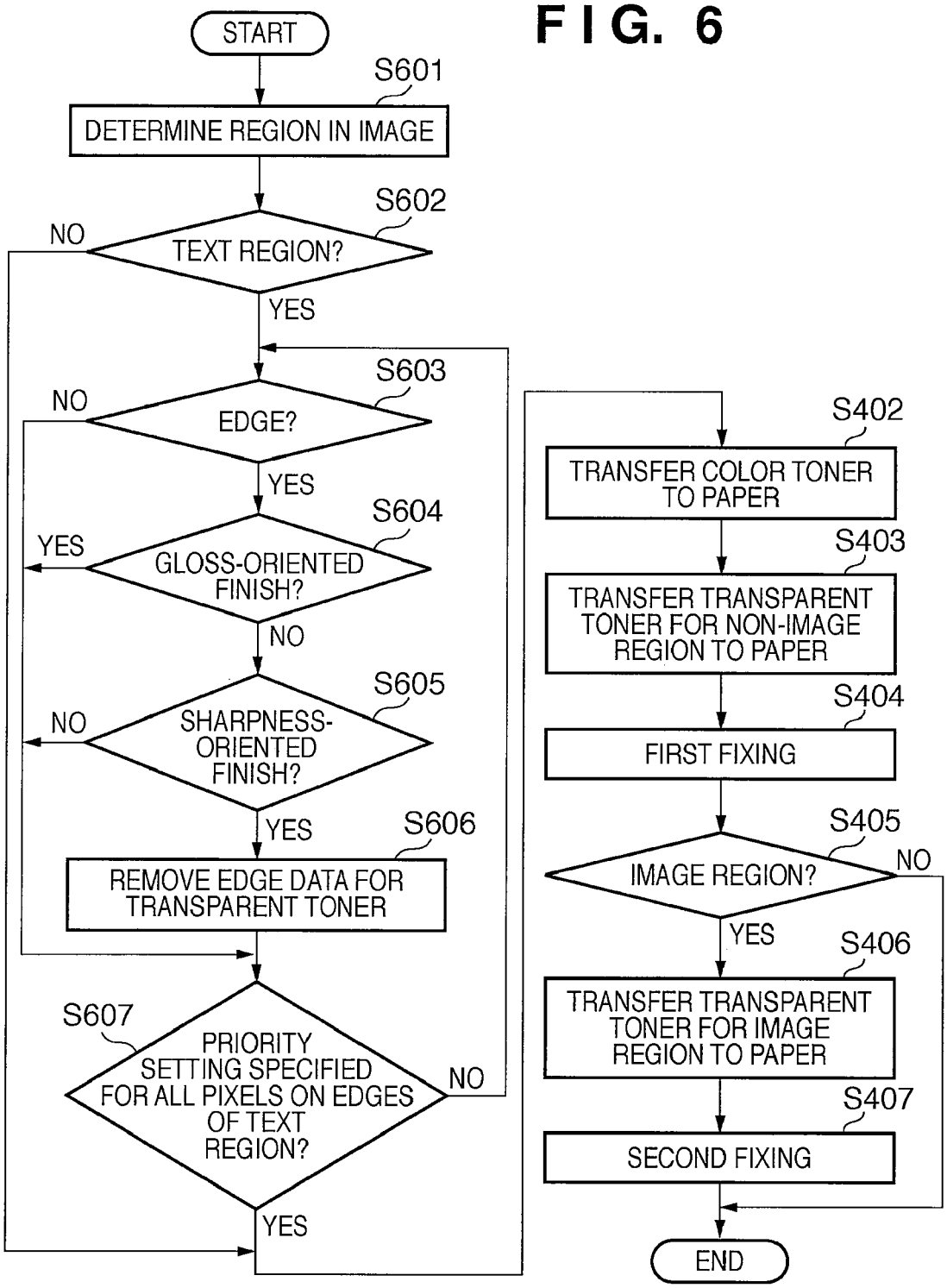
FIG. 6 is a diagram illustrating a control flow of the image forming apparatus in a third embodiment, where the image forming apparatus uses color toner and transparent toner.

Next, a third embodiment of the present invention will be described with reference to FIGS. 6 and 9. FIG. 6 is a flowchart illustrating a flow of an image forming process according to the third embodiment. The image forming process is performed under the overall control of the CPU 2001. The same processes as those in the first embodiment (FIG. 4) will be denoted by the same step numbers as the corresponding processes in the first embodiment, and redundant description thereof will be omitted.

In S601, the CPU 2001 determines a region in an image to be printed out. By referring to region information which, being attached to the image data, indicates the type of region regarding each pixel of the image, the CPU 2001 can determine whether the region is an image region which forms graphics or a text region (inner part of the text region or an edge of the text region) which forms characters.

In S602, the CPU 2001 determines whether the region checked in S601 is a text region. If the region is not a text region (S602: No), the CPU 2001 goes to S402. On the other hand, if the region is determined to be a text region in S602 (S602: Yes), the CPU 2001 goes to S603 to determine whether a given pixel belongs to an edge of the text region.

If it is determined in S603 that the pixel does not belong to an edge (S603: No), the CPU 2001 goes to S607. On the other hand, if it is determined in S603 that the pixel belongs to an edge in the text region (S603: Yes), the CPU 2001 goes to S604.

Figure 9:
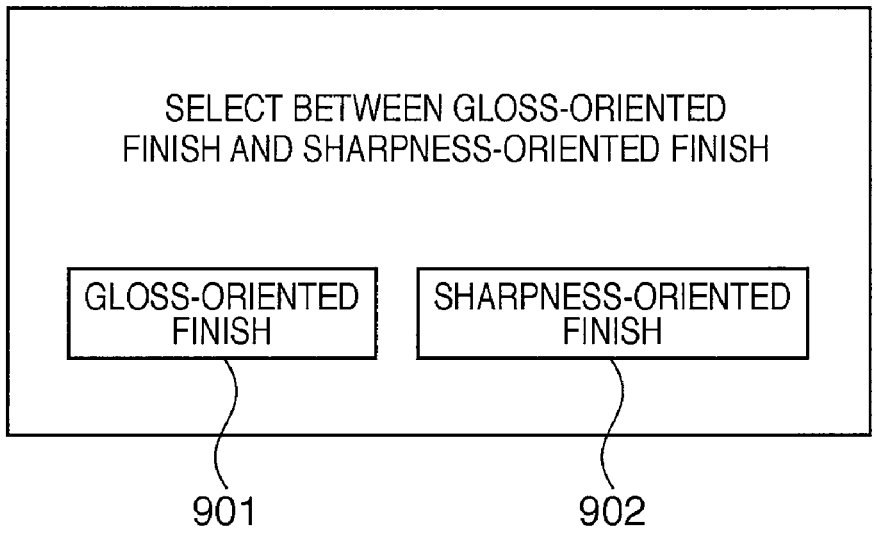
FIG. 9 is a diagram illustrating image formation according to the third embodiment.

In S604, the CPU 2001 displays a user interface screen shown in FIG. 9 on the console unit 2006. The CPU 2001 and user interface screen can function as a receiving unit which allows the user to select which takes priority in edge finish—gloss or sharpness. The user interface screen allows the user to select between gloss-oriented finish 901 which gives priority to gloss or sharpness-oriented finish 902 which gives priority to the sharpness of character outlines in the processing of the text region.

If it is determined in S604 that gloss-oriented finish is selected (S604: Yes), the CPU 2001 goes to S607. On the other hand, if gloss-oriented finish is not selected (S604: No), the CPU 2001 goes to S605 to determine whether sharpness-oriented finish is selected.

If it is determined in S605 that sharpness-oriented finish is selected (S605: Yes), the CPU 2001 goes to S606.

In S606, the CPU 2001 makes the image forming unit remove that part which corresponds to the edge from original image data, and then transfer a toner image of transparent toner (second transfer) based on resulting image data.

In S607, the CPU 2001 determines whether a priority setting (gloss-oriented finish or sharpness-oriented finish) has been specified for all pixels on edges of the text region.

If a priority setting (gloss-oriented finish or sharpness-oriented finish) has not been specified for all the pixels on edges of the text region (S607: No), the CPU 2001 returns to S603 and repeats S603 to S607. On the other hand, if it is determined in S607 that a priority setting (gloss-oriented finish or sharpness-oriented finish) has been specified for all the pixels on edges of the text region the CPU 2001 goes to S402.

In S402 to S407, the CPU 2001 performs the same processes as in the first embodiment described with reference to FIG. 4.

According to the present embodiment, edge data for transparent toner in text regions is not removed when gloss-oriented finish is selected. This makes it possible to form an image in which uniformity of gloss is maintained.

On the other hand, when sharpness-oriented finish is selected, edge data for transparent toner in text regions is removed, reducing the data for transparent toner regions by the amount equal to the removed data compared to the data for black toner regions. This makes it possible to prevent black toner from being splashed and thereby prevent loss of sharpness in character outlines when transparent toner is applied over the black toner in the text regions.

(Other Embodiments)

Needless to say, the object of the present invention can also be achieved by a computer-readable storage medium containing software program code that implements the functions of the above embodiments: the storage medium is supplied to a system or apparatus, whose computer (or a CPU or MPU) then reads the program code out of the storage medium and executes it.

In that case, the program code itself read out of the storage medium will implement the functions of the above embodiments, and the storage medium which stores the program code will constitute the present invention.

Examples of the recording medium used to supply the program code include, for example, a flexible disk, hard disk, optical disk, magneto-optical disk, CD-ROM, CD-R, non-volatile memory card, and ROM.

Also, the functions of the above embodiments can be implemented not only by the program code read out and executed by the computer, but also by part or all of the actual processing executed according to instructions from the program code by an OS (operating system) running on the computer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-235946, filed Sep. 11, 2007, which is hereby incorporated by reference herein in its entirety.

What is claimed is:

1. An image forming apparatus, comprising:

a determining unit adapted to determine whether each pixel of image data belongs to an image region or a text region, wherein the image region includes (i) a first pixel of which amounts of applied toner exceed an amount-of-applied-toner limit which represents a limit to amounts of toner which can be applied to a recording material by a single fixing operation in a case where transparent toner is transferred, and (ii) a second pixel of which amounts of applied toner do not exceed the amount-of-applied-toner limit in a case where the transparent toner is transferred;

a control unit adapted to control:

(i) transferring and fixing of color toner and transparent toner simultaneously to the text region on a recording material, in a case where the determination unit determines that a pixel of the image data belongs to the text region, and (ii) transferring and fixing of the color toner to the image region including the first and second pixels on a recording material, and transferring and fixing of a first layer of the transparent toner to the image region including the first and second pixels on the recording material which has been fed again, in a case where the determination unit determines that a pixel of the image data belongs to the image region, including the first and second pixels.

2. The image forming apparatus according to claim 1, wherein:

the determining unit determines an edge of the text region; and the control unit makes the image forming unit remove edge data from the image data based on a result of a determination of an edge of the text region produced by the determining unit and transfer a toner image of transparent toner based on image data resulting from the removal.

3. The image forming apparatus according to claim 2, further comprising a receiving unit adapted to allow selection between gloss-oriented finish and sharpness-oriented finish of the edge, wherein when the sharpness-oriented finish is selected via the receiving unit, the control unit makes the image forming unit remove edge data from the image data and transfer the toner image of transparent toner based on image data resulting from the removal, and when the gloss-oriented finish is selected via the receiving unit, the control unit makes the image forming unit transfer the toner image of transparent toner without removing edge data from the image data.

4. A control method for an image forming apparatus comprising:

a determining step of determining whether each pixel of image data belongs to an image region or a text region, wherein the image region includes (i) a first pixel of which amounts of applied toner exceed an amount-of-applied-toner limit which represents a limit to amounts of toner which can be applied to a recording material by a single fixing operation in a case where transparent toner is transferred, and (ii) a second pixel of which amounts of applied toner do not exceed the amount-of-applied-toner limit in a case where the transparent toner is transferred;

a control step of controlling:

(i) transferring and fixing of color toner and transparent toner simultaneously to the text region on a recording material, in a case where the determining step determines that a pixel of the image data belongs to the text region, and (ii) transferring and fixing of the color toner to the image region including the first and second pixels on a recording material, and transferring and fixing of a first layer of the transparent toner to the image region including the first and second pixels on the recording material which has been fed again, in a case where the determining step determines that a pixel of the image data belongs to the image region including the first and second pixels.

5. The control method for an image forming apparatus according to claim 4, wherein:

the determining step determines an edge of the text region; and the control step makes the image forming unit remove edge data from the image data based on a result of a determination of an edge of the text region produced by the determining step and transfer a toner image of transparent toner based on image data resulting from the removal.

6. The control method for an image forming apparatus according to claim 5, further comprising a receiving step of allowing selection between gloss-oriented finish and sharpness-oriented finish of the edge, wherein when the sharpness-oriented finish is selected in the receiving step, the control step makes the image forming unit remove edge data from the image data and transfer the toner image of transparent toner based on image data resulting from the removal; and when the gloss-oriented finish is selected in the receiving step, the control step makes the image forming unit transfer the toner image of transparent toner without removing edge data from the image data.

7. A non-transitory computer-readable storage medium storing a program for executing the method according to claim 4.

* * * * *